US011547896B2

(12) United States Patent
Roberts

(10) Patent No.: US 11,547,896 B2
(45) Date of Patent: Jan. 10, 2023

(54) MULTIFUNCTIONAL MOBILE EXERCISE DEVICE FOR THE UPPER EXTREMITY

(71) Applicant: Sheri Elizabeth Roberts, Tucker, GA (US)

(72) Inventor: Sheri Elizabeth Roberts, Tucker, GA (US)

( * ) Notice: Subject to any disclaimer, the term of this patent is extended or adjusted under 35 U.S.C. 154(b) by 121 days.

(21) Appl. No.: 16/949,244

(22) Filed: Oct. 21, 2020

(65) Prior Publication Data

US 2021/0113884 A1 Apr. 22, 2021

Related U.S. Application Data

(60) Provisional application No. 62/924,010, filed on Oct. 21, 2019.

(51) Int. Cl.

| | |
|---|---|
| ***A63B 21/00*** | (2006.01) |
| ***A63B 21/055*** | (2006.01) |
| ***A63B 23/12*** | (2006.01) |
| ***A63B 71/04*** | (2006.01) |
| ***A63B 21/04*** | (2006.01) |
| ***A63B 21/045*** | (2006.01) |

(52) U.S. Cl.

CPC .... *A63B 21/4035* (2015.10); *A63B 21/00185* (2013.01); *A63B 21/0442* (2013.01); *A63B 21/0455* (2013.01); *A63B 21/0552* (2013.01); *A63B 21/4039* (2015.10); *A63B 23/12* (2013.01); *A63B 71/04* (2013.01); *A63B 2208/0204* (2013.01); *A63B 2208/0233* (2013.01); *A63B 2225/093* (2013.01)

(58) Field of Classification Search

CPC ..... A63B 21/4035; A63B 21/00185; A63B 21/0442; A63B 21/0455; A63B 21/0552; A63B 21/4039; A63B 23/12; A63B 71/04; A63B 2208/0204; A63B 2208/0233; A63B 2225/093; A63B 21/08; A63B 22/20; A63B 21/4045; A63B 21/4047; A63B 21/4049

See application file for complete search history.

(56) References Cited

U.S. PATENT DOCUMENTS

| | | | | |
|---|---|---|---|---|
| 3,428,311 A | | 2/1969 | Mitchell | |
| 3,737,938 A | * | 6/1973 | Saltzstein | A47L 13/256 15/210.1 |
| 4,036,490 A | | 7/1977 | Rice | |

(Continued)

*Primary Examiner* — Andrew S Lo

(74) *Attorney, Agent, or Firm* — Dunlap Bennett & Ludwig, PLLC

(57) ABSTRACT

A multifunctional mobile exercise apparatus and method for exercising the upper extremities is disclosed. The apparatus includes a base, an elongate shaft pivotally coupled to the base, a plurality of ground lockable ground wheels supporting the base. The apparatus includes a resistance clip that is selectively positionable along a length of the elongate shaft. A cylindrical sleeve may also be provided for sliding, with or without a resistance band, along the length of the elongate shaft. The mobile exercise apparatus provides single or bilateral hold for one or more resistance bands and the mobile arm. The resistance band and the mobile arm can be held by the injured or non-injured extremity. The elongate shaft and locks up to 8 feet high, and can also be used for the attachment jumbo resistance clips, or for the sliding exercises.

1 Claim, 8 Drawing Sheets

(56) References Cited

U.S. PATENT DOCUMENTS 4,249,727 A * 2/1981 Dehan ..... A63B 21/015 482/117
4,569,519 A 2/1986 Mattox et al.
4,772,015 A * 9/1988 Carlson ..... A63B 21/4047 482/902
5,071,279 A * 12/1991 Rutstrom ..... F16M 11/14 403/114
5,244,444 A * 9/1993 Wostry ..... A63B 21/4047 482/109
5,316,533 A * 5/1994 Hoker ..... A63B 21/0004 482/121
5,681,246 A 10/1997 Dougherty
5,718,656 A 2/1998 Byrd et al.
5,759,139 A 6/1998 Wright
6,165,111 A 12/2000 Walker
7,090,626 B1 8/2006 Miller
7,125,365 B2 10/2006 Krietzman
7,354,382 B1 * 4/2008 Warren, II ..... A61H 3/04 482/68
7,402,127 B2 7/2008 Rizzo
8,317,668 B2 * 11/2012 Sales ..... A63B 21/068 482/146
8,636,630 B2 * 1/2014 Morris ..... A63B 23/1209 482/117
8,858,401 B2 10/2014 Kaupe
8,900,009 B2 * 12/2014 Hornick ..... H01F 7/0205 439/38
10,022,581 B2 7/2018 Lagree
10,434,353 B1 * 10/2019 Fabbri ..... A63B 21/00185
2002/0151416 A1 * 10/2002 List ..... A63B 21/154 482/121
2003/0013586 A1 1/2003 Rothschild
2004/0072663 A1 * 4/2004 Ardito ..... A63B 21/16 482/121
2004/0185990 A1 * 9/2004 Orescan ..... A63B 69/36 482/121
2005/0215358 A1 * 9/2005 Woodard ..... A63B 69/0071 473/481
2008/0234116 A1 * 9/2008 Elzerman ..... A63B 21/015 482/123
2009/0069161 A1 * 3/2009 Caldwell ..... A63B 21/4035 482/142
2010/0248918 A1 * 9/2010 Nakamura ..... A63B 21/4047 482/139
2010/0301582 A1 * 12/2010 Tsai ..... B62K 15/008 280/278
2011/0281701 A1 * 11/2011 Zhang ..... A63B 22/14 482/146
2012/0094812 A1 * 4/2012 Smiley ..... A63B 21/05 482/128
2015/0202484 A1 * 7/2015 Lalaoua ..... A63B 23/0211 482/130
2018/0099186 A1 * 4/2018 Boysen ..... A63B 26/003
2018/0221700 A1 * 8/2018 George ..... A63B 23/0355
2019/0192949 A1 6/2019 Urban et al.
2019/0217173 A1 * 7/2019 Kaye ..... A63B 1/00
2019/0282847 A1 * 9/2019 Acuna, Jr. ..... A63B 21/4035
2020/0101342 A1 * 4/2020 Lawton ..... A63B 21/0004 482/121
2020/0101343 A1 * 4/2020 Gonzales ..... A63B 21/16 482/121
2021/0236870 A1 * 8/2021 Bergengren ..... A63B 69/36 482/121

* cited by examiner

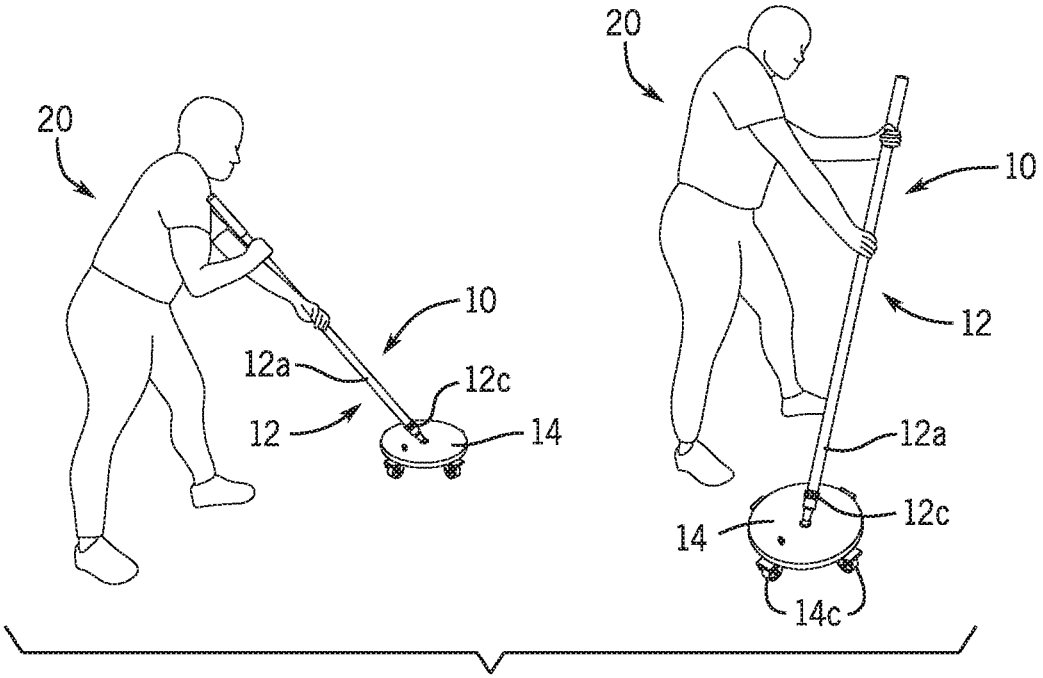
FIG. 10
FIG. 11
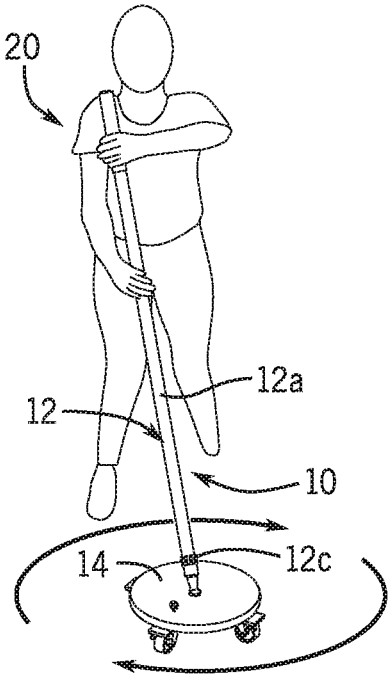

MULTIFUNCTIONAL MOBILE EXERCISE DEVICE FOR THE UPPER EXTREMITY

CROSS-REFERENCE TO RELATED APPLICATION

This application claims the benefit of priority of U.S. provisional application No. 62/924,010, filed Oct. 21, 2019, the contents of which are herein incorporated by reference.

BACKGROUND OF THE INVENTION

The present invention relates to exercise apparatus, and more particularly to apparatus and methods for providing rehabilitative exercise therapies to upper extremities.

Treatment of upper extremity conditions are traditionally one dimensional and limited by the parameters of the device, leaving therapists with minimal options for expanded applications, including the physical space needed for the exercises and positioning of the body during exercises.

Exercise systems with single applications, such as a barbell, can create an uninteresting environment for rehabilitation of the upper extremity. This is further exacerbated by therapists who lack creativity and knowledge of how to adapt and manage exercises in a stimulating and successful manner.

Other devices/systems are not offered as a combination, multi-functional unit or process that takes a minimal amount of space, or other devices are part of very large, non-mobile systems attached to a wall or using a great deal of physical space in the Rehab Centre.

As can be seen, there is a need for improved apparatus and methods for rehabilitative therapy for the upper extremities.

SUMMARY OF THE INVENTION

In one aspect of the present invention, an exercise apparatus is disclosed. The exercise apparatus includes a base having a top surface and a bottom surface. An elongate shaft is pivotally coupled to the top surface of the base. A plurality of ground wheels support the base. At least one of the plurality of ground wheels is operable between a locked condition and an unlocked condition, such that in the locked condition, rotation of the at least one of the plurality of ground wheels is restricted, and in the unlocked condition, the at least one of the plurality of ground wheels roll across a supporting ground surface.

In some embodiments, the elongate shaft includes an upper shaft element and a lower shaft element telescopically coupled to adjust a length of the elongate shaft. A shaft coupling is operable between a fixed condition in which a longitudinal length of the elongate shaft is fixed and an movable condition in which the length of the elongate shaft may be varied by telescopic sliding of the upper shaft element relative to the lower shaft element.

In some embodiments, a cylindrical sleeve has an inner diameter to receive and slide along a length of the elongate shaft. The cylindrical sleeve has a length that permits a user to grasp the cylindrical sleeve and slide the cylindrical sleeve along a length of the elongate shaft. A gripping surface, selected from the group consisting of indentations and finger ridges, is defined on an outer surface of the cylindrical sleeve. The cylindrical sleeve may also include an attachment for coupling a resistance band to the cylindrical sleeve.

In some embodiments, an attachment point is carried on the base. A resistance band is configured for attachment to the attachment point.

In some embodiments, one or more resistance clips are provided. The one or more resistance clips have a jaw for clamping to the elongate shaft and retaining the one or more resistance clips at a stationary position on the elongate shaft. Each of the one or more resistance clips have a different operating force to open the jaws.

In other aspects of the invention, a method of exercising an upper extremity is disclosed. The method includes providing an exercise apparatus having a base, a plurality of selectively lockable ground transport wheels supporting the base, an elongate shaft pivotally coupled to the base, and a cylindrical sleeve having an inner diameter to receive the elongate shaft therein. The method includes grasping the cylindrical sleeve and selectively elevating and lowering the cylindrical sleeve along the elongate shaft.

In some embodiments, the method includes attaching a resistance band between the cylindrical sleeve and the base and selectively elevating and lowering the cylindrical sleeve against a tension of the resistance band.

In other aspects of the invention, a method of exercising an upper extremity of a user is disclosed. This method includes providing an exercise apparatus having a base, a plurality of selectively lockable ground transport wheels supporting the base, and an elongate shaft pivotally coupled to the base. A first end of a resistance band is coupled to the elongate shaft. The elongate shaft is then grasped by a first hand while a second end of the resistance band is grasped by a second hand. The second hand is moved against a tension of the resistance band.

In some embodiments, the moving the second hand against the tension of the resistance band includes rotating a forearm of the second hand laterally outwardly against the tension of the resistance band and returning the forearm inwardly against the tension of the resistance band.

In some embodiments of the step of moving the second hand against the tension of the resistance band includes extending an arm of the second hand laterally outwardly against the tension of the resistance band and returning the arm of the second hand inwardly against the tension of the resistance band.

In other embodiments, the step of moving the second hand against the tension of the resistance band includes extending an arm of the second hand rearwardly against the tension of the resistance band and returning the arm of the second hand inwardly against the tension of the resistance band.

In yet other embodiments, the method includes tilting the elongate shaft from a vertical orientation.

These and other features, aspects and advantages of the present invention will become better understood with reference to the following drawings, description and claims.

BRIEF DESCRIPTION OF THE DRAWINGS

FIG. 10 shows two positions of the mobile arm using different motions from those shown in FIG. 9.

FIG. 11 shows the mobile arm used in a rotary motion.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention.

Broadly, embodiments of the present invention provide an exercise apparatus and methods for rehabilitation therapies that feature single or bilateral hold on the resistance bands and a mobile arm apparatus. The band and the mobile arm can be held by the injured or non-injured extremity. The mobile arm can also be held by the therapist to facilitate a therapeutic session. Increased resistance can be provided by the therapist during the exercises or the patient can shorten or lengthen the bands themselves. The mobile arm apparatus challenges the patient with at least 49 different upper extremity movement patterns including the ability to gain mobility, strength, and stability within the realm of one mobile treatment device. The mobile arm treatment device combines treatment/exercise applications in streamlined manner in both the physical space it uses and the execution of the exercises.

The mobile arm apparatus is configurable between a rolling exercise platform or a stationary platform that remains stable. The mobile arm apparatus is self-contained, can be used in any part of the gym, does not require any door or wall attachments, and occupies a minimal amount of space. The movement arm expands and locks up to 8 feet high, and can also be used for the attachment jumbo resistance clips, or for the sliding.

Figure 1:
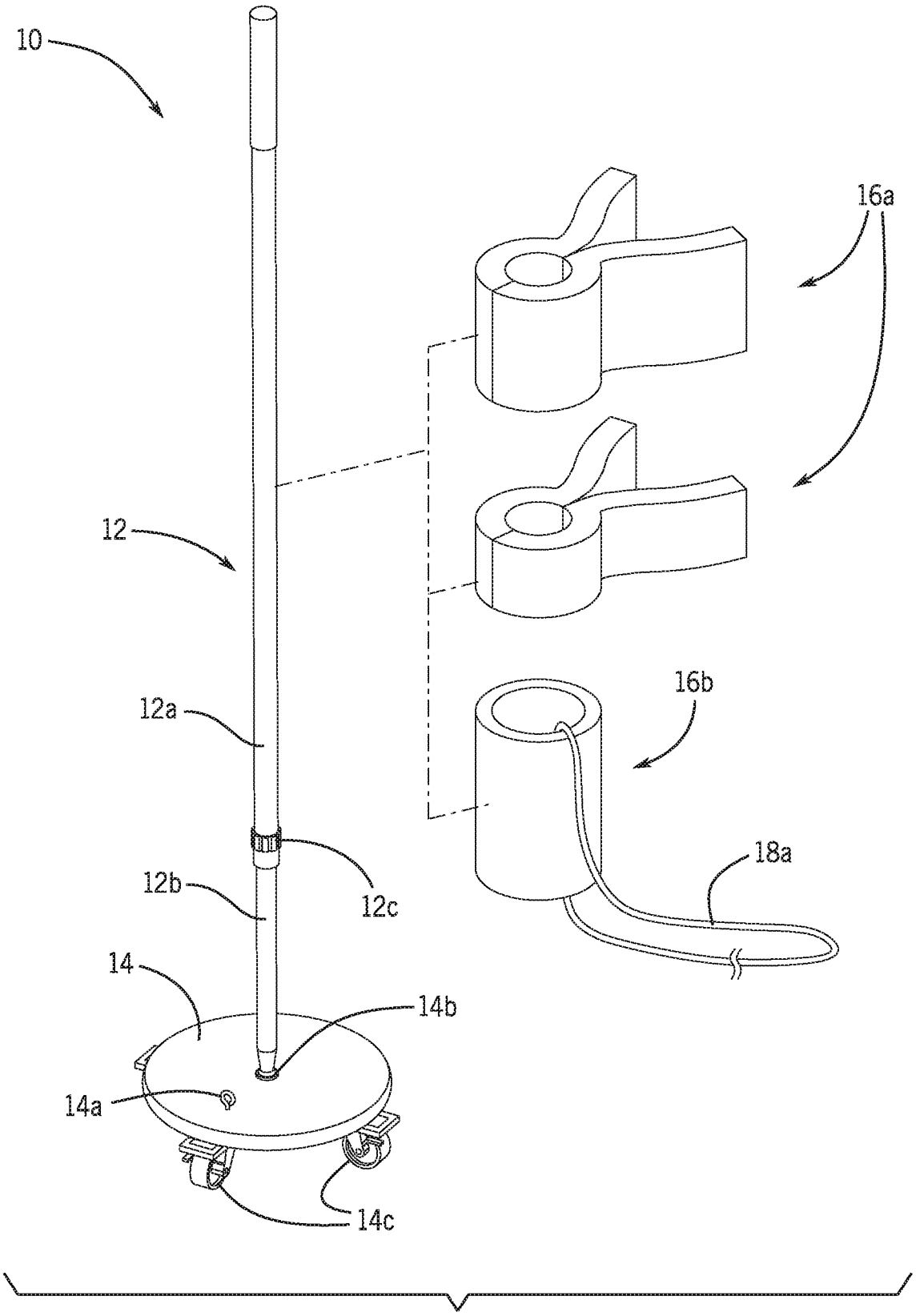
FIG. 1 is a front perspective view of the mobile arm multifunctional mobile exercise device.

As seen in reference to FIG. 1, the mobile arm treatment apparatus 10 includes an elongate shaft 12 that is pivotally coupled to a base 14. The pivotal coupling may, for example be one of a universal joint 14*b* or a ball and socket joint 14*b*. A plurality of ground wheels 14*c*, such as casters, are disposed in a spaced apart relation about a bottom of the base 14. Preferably, the ground wheels 14*c* may be selectively positioned between a locked condition restricting rolling and an unlocked condition in which the wheels 14*c* are free rolling.

The elongate shaft 12 may be formed from a telescoping upper shaft segment 12*a* and a lower shaft segment 12*b*. A shaft coupling 12*c* is operable between a locked condition in which a length of the elongate shaft 12 is fixed and an unlocked condition in which the length of the elongate shaft 12 may be varied by telescopic sliding of the upper shaft segment 12*a* relative to the lower shaft segment 12*b*. A handle may be disposed at a distal end of the elongate shaft 12 opposite the pivotal connection 14*b* to the base 14. The elongate shaft 12 may be telescopically extensible to a length of up to 8 feet.

The base 14 includes at least one attachment point 14*a*, to operatively couple a resistance band 18*a* to the base 14. The resistance band 18*a* may be an elastic strap, band, or tube that provides a selected resistance as the resistance band 18*a* stretched during an exercise routine. The resistance band 18*a* may be selected from a plurality of resistance bands each having a different resistance.

The mobile arm treatment apparatus 10 may also include a plurality of attachments targeted for a specified therapy. The plurality of attachments may include one or more resistance clips 16*a* that have a jaw for clamping to the elongate shaft 12 and retaining the one or more resistance clips 16*a* at a stationary position on the elongate shaft. The one or more resistance clips 16*a* are operable by lever arms to selectively open and close the jaws. Each of the one or more resistance clips 16*a* may have a different operating force to open the jaws, the operating force being selected based on the abilities of the patient.

The plurality of attachments may also include a cylindrical sleeve 16*b* having an inner diameter to fit over and slide along a length of the elongate shaft. The cylindrical sleeve 16*b* will have a length that permits the user to grasp the cylindrical sleeve 16*b* and slide the cylindrical sleeve 16*b* along a length of the elongate shaft 12. The cylindrical sleeve 16*b* may have a gripping surface, such as indentations or finger ridges for patients with a limited gripping strength. The cylindrical sleeve 16*b* may also be provided without a gripping surface for patients who have developed a stronger gripping strength. The cylindrical sleeve 16*b* may also include an attachment for coupling the resistance band 18*a* to the cylindrical sleeve 16*b*.

As indicated, the mobile arm treatment apparatus 10 of the present invention provides for a variety of therapeutic exercises to facilitate rehabilitation of the upper extremities. The exercises may be performed with the patient in either a seated or a standing position, depending on their mobility, balance, and other conditions.

Figure 2:
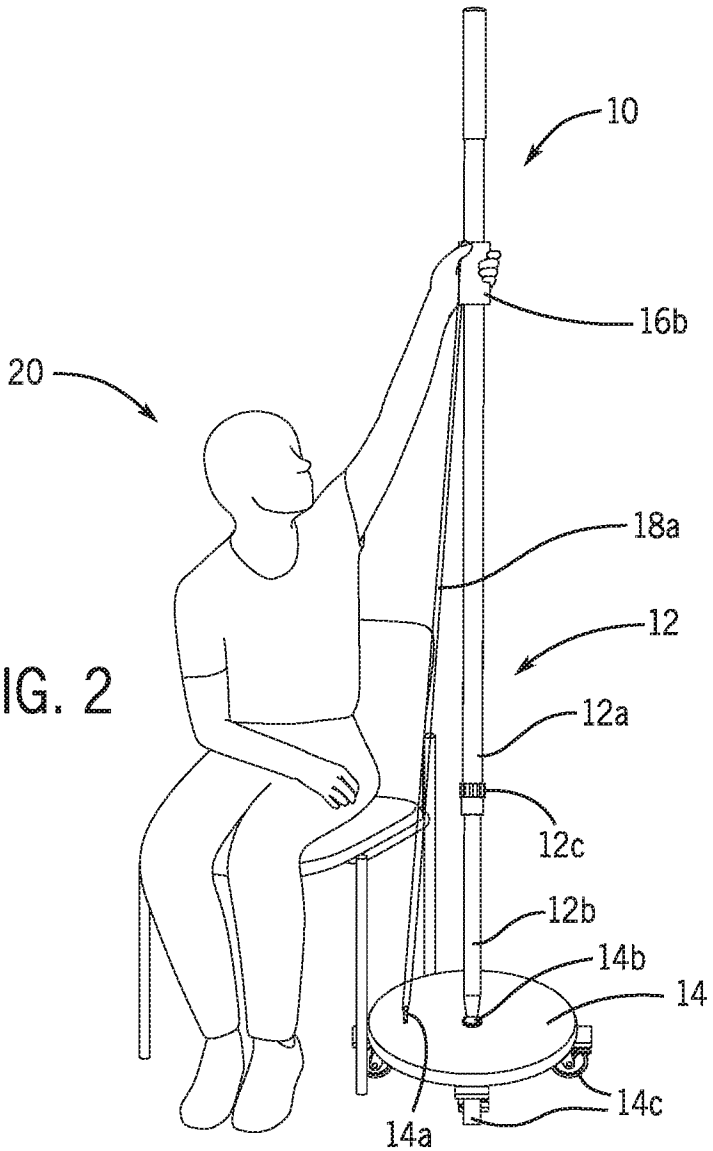
FIG. 2 is a front perspective view of the multifunctional mobile exercise device in use with the mobile arm, cylinder slider and a first resistance band.

FIG. 2, shows a shoulder resistance exercise. The shoulder resistance exercise may be performed with the user 20 in a seated position with the mobile arm apparatus 10 configured with the cylindrical sleeve 16*b* positioned over the elongate shaft 12. Depending on the patient's fitness level, the shoulder resistance exercise may include a resistance band 18*a* coupled between the cylindrical sleeve 16*b* and the attachment point 14*a* on the base 14.

To execute the shoulder resistance exercise, the user 20 grips the cylindrical sleeve 16*b* and elevates the cylindrical sleeve 16*b* along the elongate shaft 12. Resistance may be provided by the tension of the resistance band 18*a* as the patient elevates the cylindrical sleeve 16. The should resistance exercise may be performed with the elongate shaft 12 positioned laterally from the seated patient to shoulder resistance exercise allows the patient to work the supraspinatus, deltoid, trapezius, and serratus anterior. muscles. The exercise may be performed with the elongate shaft 12 positioned in front of the patient. When positioned in front of the patient, the anterior deltoid, pectoralis major and coracobrachialis muscles are targeted.

Figure 3:
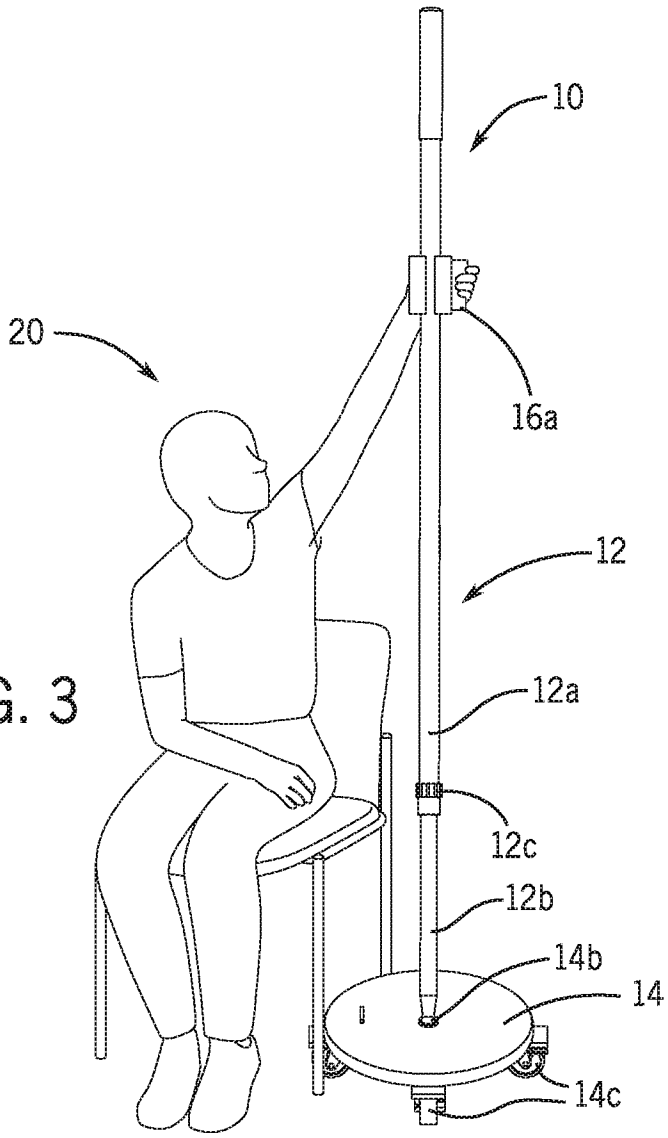
FIG. 3 is a perspective view of the multifunctional mobile exercise device in use with a resistance clip.

As seen in reference to FIG. 3, a shoulder stretching, and hand gripping exercise is shown. The exercise may be performed with the user in a seated position. The user 20 grips the resistance clip 16*a* and reaches to a set goal made by the therapist. The set goal may be a vertical elevation along the elongate shaft 12, an operating resistance of the selected resistance clip 16*a*. Resistance is provided by the tension of the clip opening and closing around the elongate shaft 12 of mobile arm apparatus 10.

The shoulder stretching and hand gripping exercise may be performed with the elongate shaft 12 positioned laterally from the seated patient to exercise the supraspinatus, deltoid, trapezius, and serratus anterior. muscles. The shoulder stretching and hand gripping exercise may be performed with the elongate shaft 12 positioned in front of the patient 20. When positioned in front of the patient 20, the anterior deltoid, pectoralis major and coracobrachialis. muscles are targeted. In either position the interosseous muscles and long flexors (flexor digitorum profundus and superficialis) and extensors (extensor digitorum) are targeted.

Figure 4:
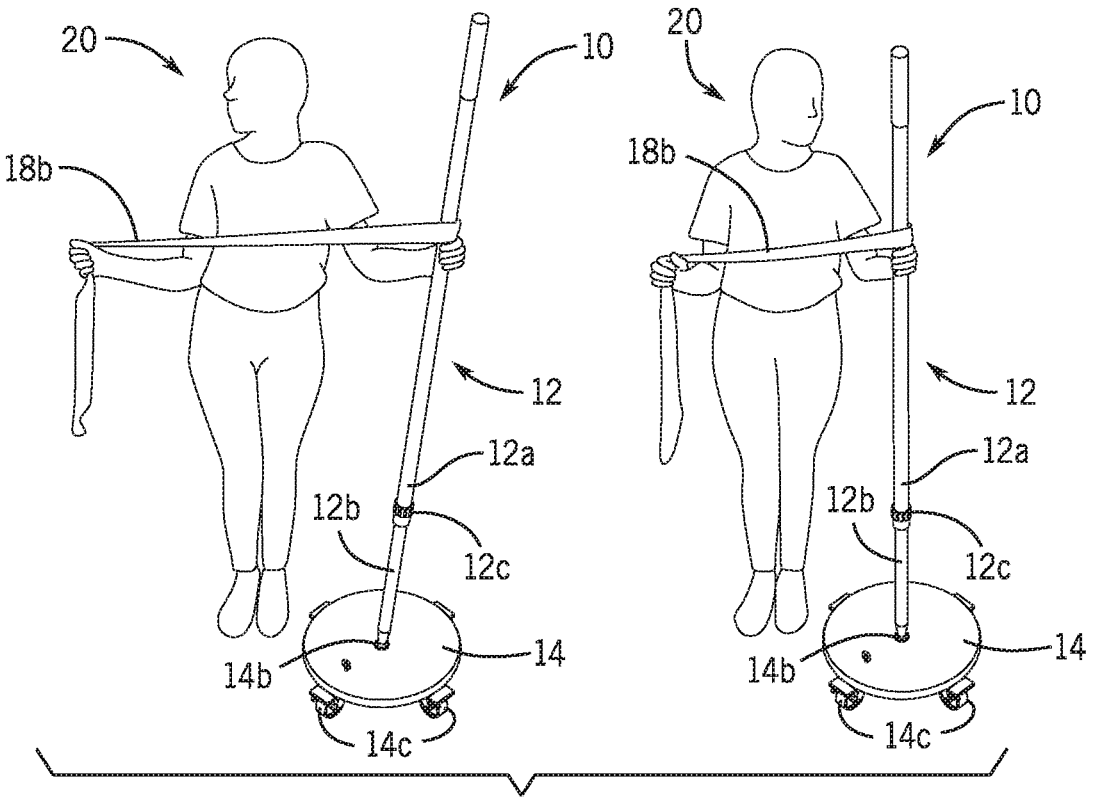
FIG. 4 shows the use of two positions in the use of a second resistance band.

FIG. 4 shows a rotational shoulder resistance exercise. The rotational shoulder resistance exercise may be performed with the user 20 in a standing position. The user 20 grips the resistance band 18*b* and externally rotates the shoulder. Resistance is provided by the tension of the resistance band 18*b* as the patient 20 rotates the forearm outward. The rotational shoulder resistance exercise is performed with the elongate shaft 12 positioned laterally from the standing patient 20 to exercise the teres major, teres minor and infraspinatus. muscles. The patient returns the band 18*b* to a neutral position using pectoralis major, subscapularis, teres major and latissimus muscles.

Figure 5:
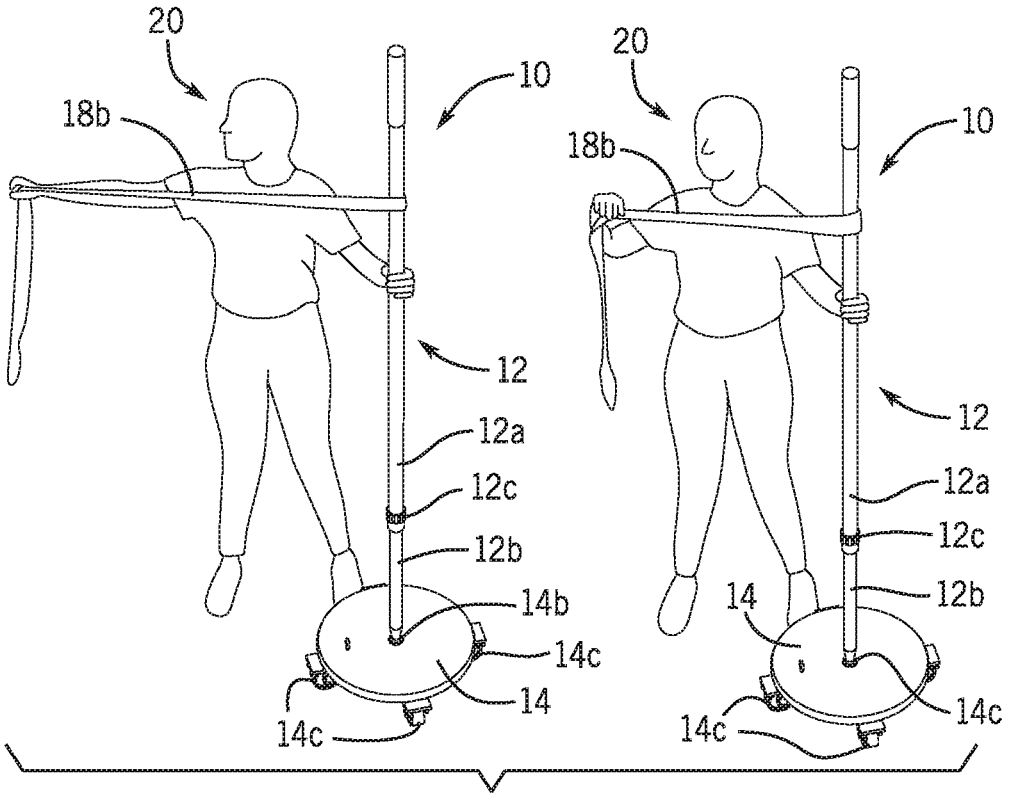
FIG. 5 shows two positions of the second resistance band with arm extended and arm contracted.

FIG. 5, shows an elbow resistance exercise. The elbow resistance exercise may be performed with the user 20 in a standing position. The user 20 grips the resistance band 18*b* starting with the elbow in a flexed position, seen in the right frame of FIG. 5, then extending the elbow. Resistance is provided by the tension of the resistance band 18*b* as the patient 20 extends the elbow. The exercise may be performed with the elongate shaft 20 positioned laterally from the patient with the triceps muscle being targeted.

Figure 6:
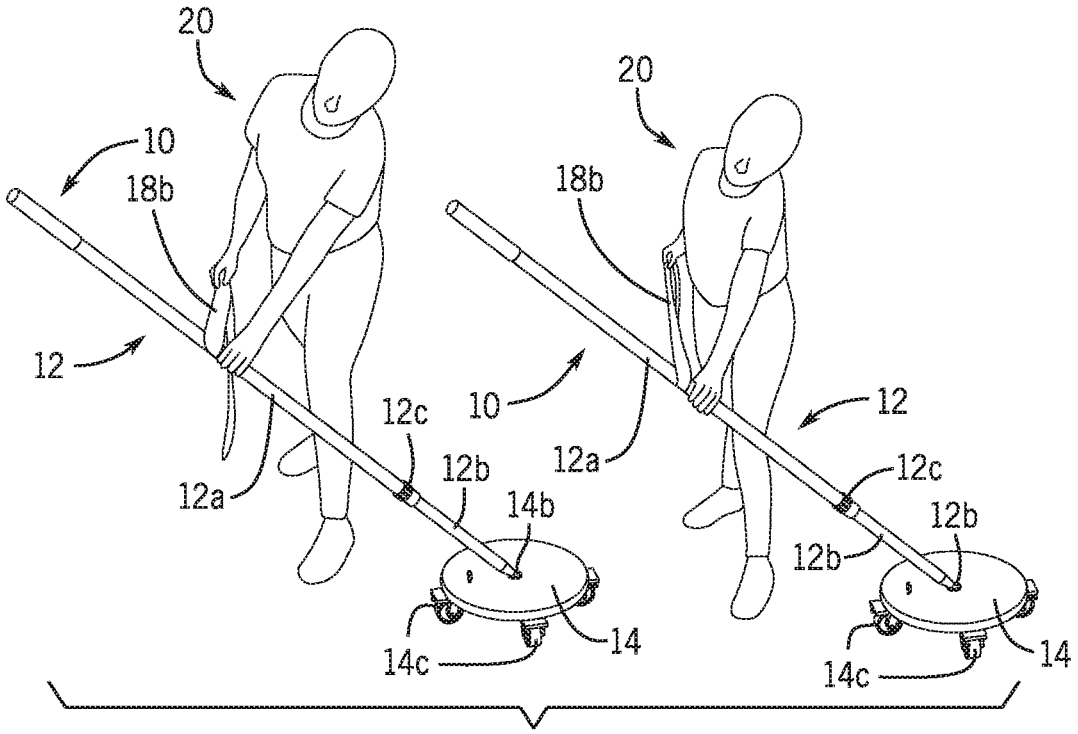
FIG. 6 shows two positions of the second resistance band with band relaxed and band extended.

FIG. 6 shows an aft extension shoulder resistance exercise. The aft extension shoulder resistance exercise may be performed with the user 20 in a standing position. The user 20 grips the resistance band 18*b* with the arm starting in a neutral shoulder extension position. Resistance is provided by the tension of the resistance band 18*b* as the patient 20 pulls the band into shoulder extension . The exercise is performed with the elongate shaft 12 positioned anterior and semi vertical from the standing patient 20 to exercise the latissimus dorsi, teres major and minor and posterior deltoid muscles.

Figure 7:
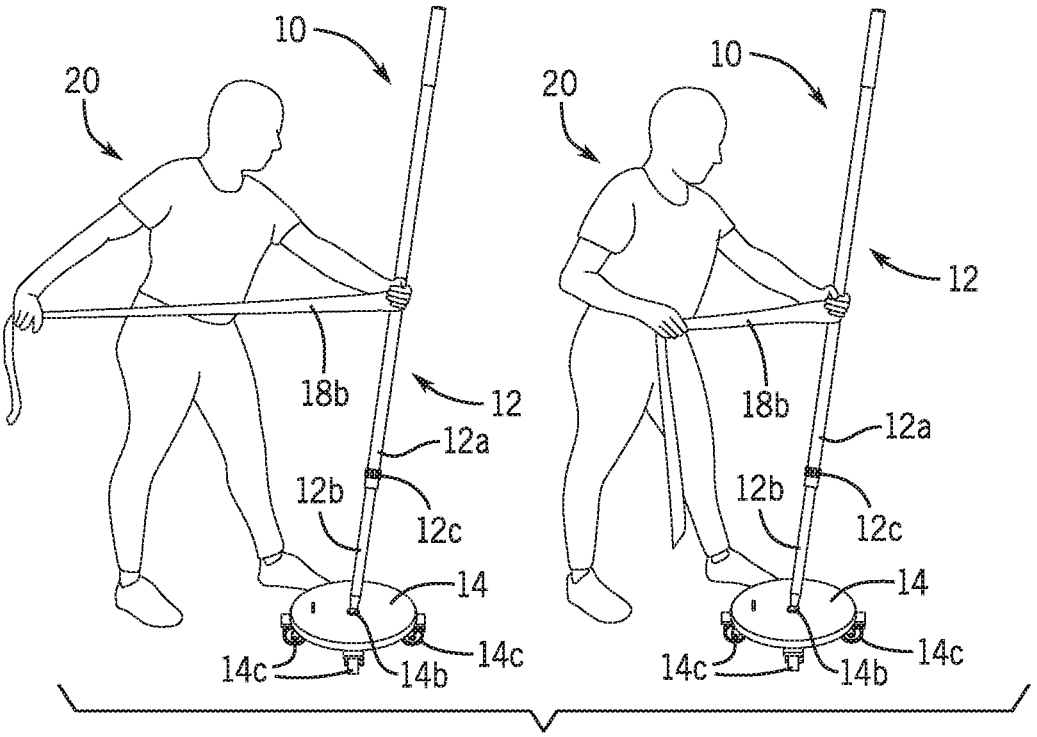
FIG. 7 shows two other positions of the second resistance band with band relaxed and band extended.

FIG. 7, shows an elbow and shoulder resistance exercise. The elbow and shoulder resistance exercise may be performed with the user 20 in a standing position. The user 20 grips the resistance band 18*b* starting with the elbow in a semi-flexed condition, then extends the elbow. Resistance is provided by the tension of the resistance band 18*b* as the patient 20 extends the elbow and shoulder. The elbow and shoulder resistance exercise may be performed with the elongate shaft 12 positioned anterior to the patient 20 with the triceps, latissimus dorsi, teres major and minor and posterior deltoid muscles being targeted.

Figure 8:
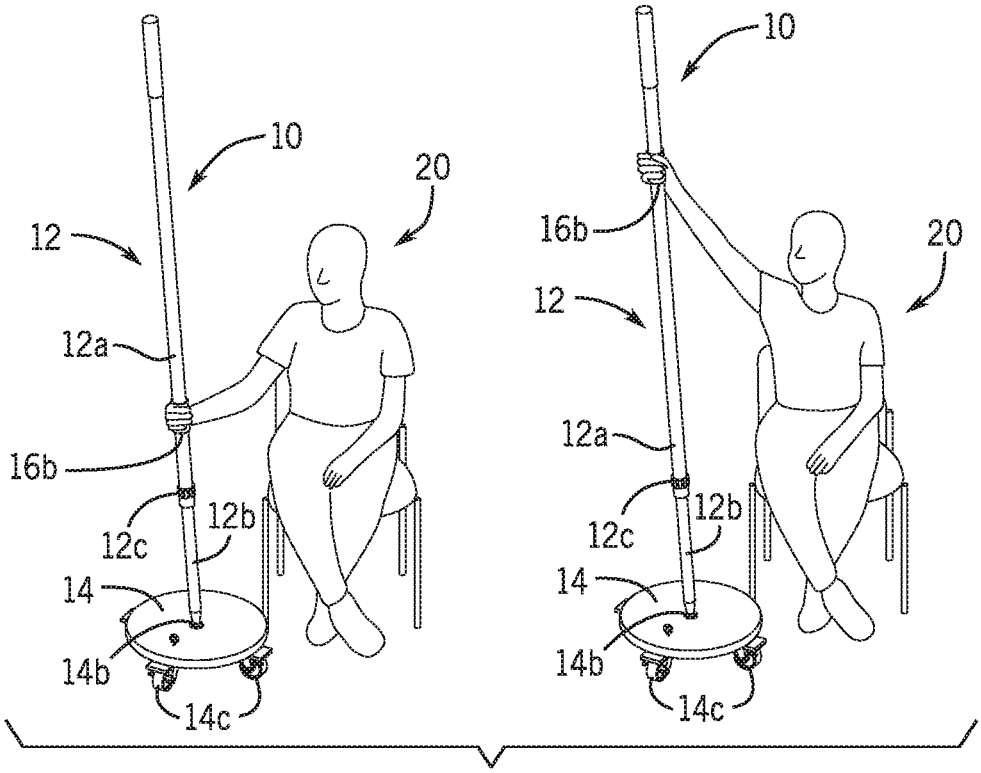
FIG. 8 shows two positions of the cylinder slider while being used from a seated position.

FIG. 8, shows a shoulder stretching exercise. The exercise is performed with the user in a seated position. The user grips the cylindrical sleeve 16*b* and reaches upward along the elongate shaft 12 into flexion. The shoulder stretching exercise may be performed with the elongate shaft 12 positioned laterally from the seated patient to exercise the supraspinatus, deltoid, trapezius, and serratus anterior. muscles. The shoulder stretching exercise may be performed with the elongate shaft positioned in front of the patient 20. When positioned in front of the patient 20, the anterior deltoid, pectoralis major, and coracobrachialis muscles are targeted.

Figure 9:
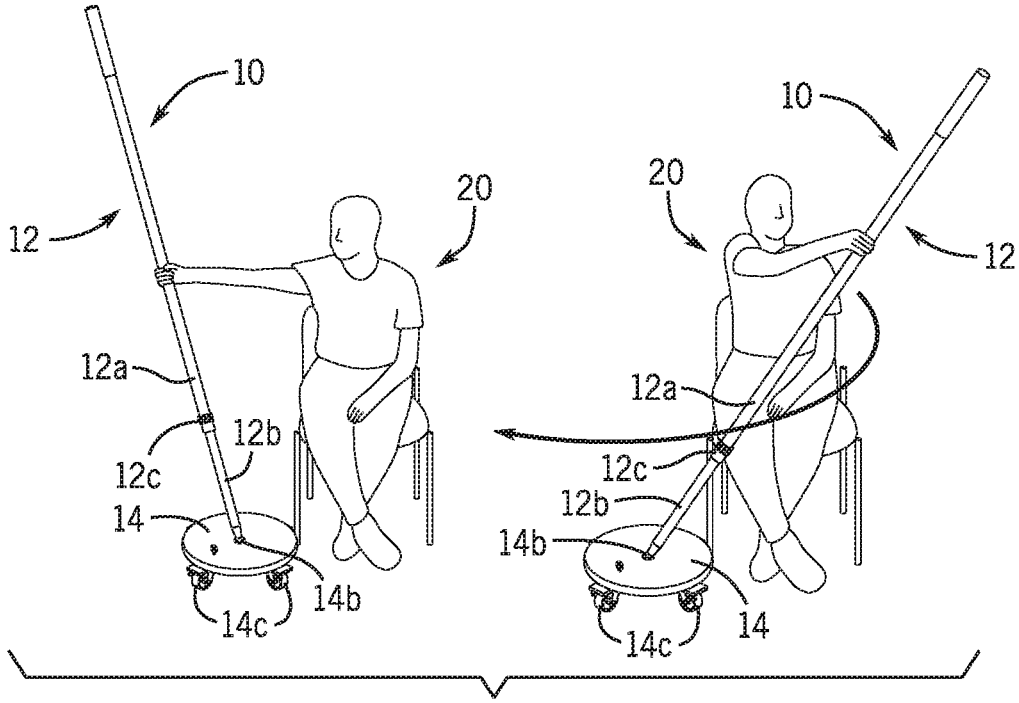
FIG. 9 shows two positions of the mobile arm in use without employing the cylinder slider or the resistance clip.

FIG. 9, shows a shoulder swing stretching exercise. The shoulder swing stretching exercise may be performed with the user 20 in a seated position. The user 20 grips the elongate shaft 12 of the mobile arm device 10 and moves it from a position of shoulder flexion and abduction to a position of shoulder flexion and horizontal adduction. The shoulder swing stretching exercise may be performed with the elongate shaft 12 positioned laterally from the seated patient 20 to exercise the supraspinatus, deltoid, trapezius, and serratus anterior. For abduction and anterior deltoid and serratus for horizontal adduction. Shoulder flexion is accomplished through anterior deltoid, pectoralis major and coracobrachialis.

FIG. 10 illustrates a shoulder stability exercise. The shoulder stability exercise is performed with the user 20 in a standing position, with dynamic stability in the core musculature. The user 20 grips the mobile arm elongate shaft 10 and moves it in a forward then backward motion pushing and pulling the base 14 with the ground wheels 14*c* in an unlocked position. The shoulder stability exercise may be performed with the elongate shaft 12 moving freely in a forward and backward plane of motion. The serratus anterior and the subscapularis, trapezius, rhomboids, levator scapulae, serratus anterior, deltoid, the biceps, the triceps, Supraspinatus, infraspinatus and teres minor are targeted by the shoulder stability exercise.

FIG. 11 shows a shoulder stability exercise. The exercise is performed with the user in a standing position, with dynamic stability in the core musculature. The user grips the mobile arm and moves it in a circular motion with wheels unlocked, stabilizing the arm and keeping in a small radius, The exercise may be performed with the shaft moving freely in a circular motion The serratus anterior and the subscapularis, trapezius, rhomboids, levator scapulae, serratus anterior, deltoid, the biceps, and the triceps. Supraspinatus, infraspinatus and teres minor are targeted.

Figure 12:
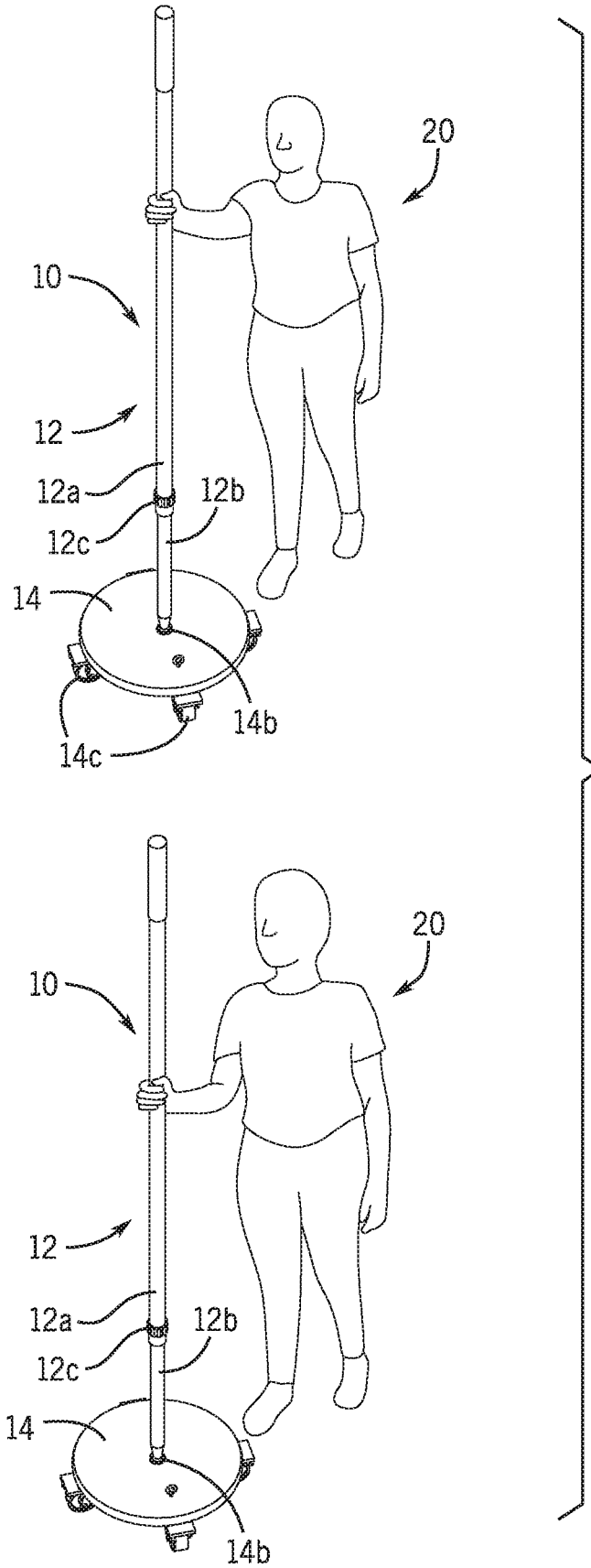
FIG. 12 shows a simplified use of the mobile arm.

FIG. 12 shows a shoulder extension stability exercise. The shoulder extension stability exercise is performed with the user 20 in a standing, then ambulating position, with dynamic stability targeted in the core musculature. The user 20 grips the elongate shaft 12 with the shoulder in 90 of stabilized shoulder flexion, then ambulates forward with the ground wheels 14*c* in the unlocked condition The shoulder extension stability exercise may be performed with the elongate shaft 12 anterior to the patient in an upright position. The serratus anterior and the subscapularis, trapezius, rhomboids, levator scapulae, serratus anterior, deltoid, the biceps, the triceps, Supraspinatus, infraspinatus and teres minor are targeted by the shoulder extension stability exercise.

Figure 13:
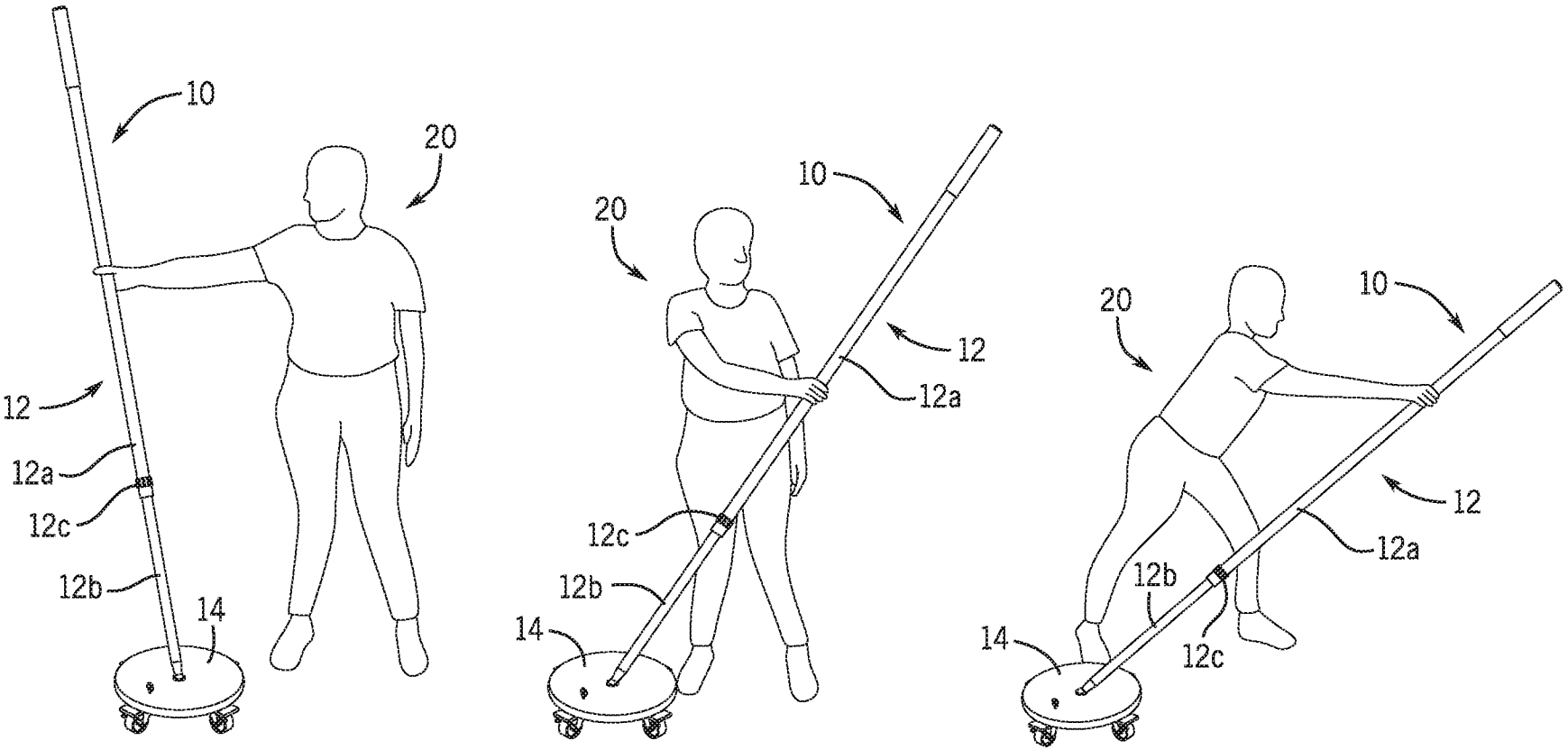
FIG. 13 shows the mobile arm used in a three-position exercise routine.

FIG. 13, illustrates a shoulder stretching and trunk rotation exercise. The shoulder stretching and trunk rotation exercise is performed with the user 20 in a standing position. The user 20 grips the elongate shaft 12 and moves it from a position of shoulder flexion and abduction to a position of shoulder flexion and horizontal adduction. The shoulder stretching and trunk rotation exercise is performed concurrent with a trunk rotation and a lunging to the end point. The exercise may be performed with the elongate shaft 12 positioned laterally from the seated patient 20 to exercise the supraspinatus, deltoid, trapezius, and serratus anterior. For abduction and anterior deltoid and serratus for horizontal adduction. Shoulder flexion is accomplished through anterior deltoid, pectoralis major and coracobrachialis. For the trunk External oblique, Rectus abdominis, Lumbar multifidus, Internal oblique, are targeted as the patient 20 rotates and turns the trunk.

It should be understood, of course, that the foregoing relates to exemplary embodiments of the invention and that modifications may be made without departing from the spirit and scope of the invention as set forth in the following claims.

What is claimed is:

1. A method of exercising an upper extremity of a user, comprising:

providing an exercise apparatus having a base, a plurality of selectively lockable ground transport wheels supporting the base, an elongate shaft pivotally coupled to the base, and a cylindrical sleeve having an inner diameter to receive the elongate shaft therein;

attaching a resistance band between the cylindrical sleeve and the base;

grasping the cylindrical sleeve; and selectively elevating and lowering the cylindrical sleeve along the elongate shaft against a tension of the resistance band.

* * * * *